US006530252B1

(12) United States Patent
Hashimoto et al.

(10) Patent No.: US 6,530,252 B1
(45) Date of Patent: Mar. 11, 2003

(54) HYDROFORMING METHOD AND HYDROFORMING DEVICE

(75) Inventors: Masakazu Hashimoto, Tokyo (JP); Shinjiro Sato, Yokohama (JP); Takashi Koshimizu, Zama (JP); Hiroshi Hosoya, Tokyo (JP); Kazuo Kitazawa, Sagamihara (JP); Hiromichi Miyata, Tokyo (JP); Shinichi Kaji, Kanazawa (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 09/598,727

(22) Filed: Jun. 21, 2000

(30) Foreign Application Priority Data

Jun. 21, 1999 (JP) ..... 11-173850
Sep. 21, 1999 (JP) ..... 11-266518

(51) Int. Cl.[7] ..... B21D 26/02; B21D 39/08

(52) U.S. Cl. ..... 72/58; 72/61; 72/370.22; 29/421.1

(58) Field of Search ..... 72/58, 61, 62, 72/370.22; 29/421.1

(56) References Cited

U.S. PATENT DOCUMENTS 3,335,590 A * 8/1967 Early ..... 72/58
3,350,905 A * 11/1967 Ogura et al. ..... 72/58
4,051,704 A * 10/1977 Kimura ..... 72/58
6,006,567 A * 12/1999 Brown et al. ..... 72/58
6,014,879 A * 1/2000 Jackel et al. ..... 72/61
6,029,487 A * 2/2000 Genin et al. ..... 72/58
6,041,633 A * 3/2000 Bieling ..... 72/61
6,128,936 A * 10/2000 Yogo ..... 72/58

* cited by examiner

*Primary Examiner*—David Jones
(74) *Attorney, Agent, or Firm*—Darby & Darby

(57) ABSTRACT

A plurality of closing cylinder devices are provided between a bolster of a press machine and a bed containing a lower mold of a hydroforming device. An upper mold is attached to a slide of the press machine. The upper mold and lower mold come together to form a cavity having the shape of the exterior of the desired molded product. A closing block, being movable between a first position which is between the slide and a crown of the press machine, and a second position, which avoids the slide, permitting free movement of the slide from the crown to the lower mold. When a material to be hydroformed is place in the lower mold, the upper mold is lowered. The closing block is fit into its first position, thereby restricting movement of the slide in the vertical direction. A inner work pressure is provided by a fluid inside the material to be molded. The closing cylinder devices provide a pressure, based upon the inner work pressure, to maintain the cavity at the desired shape, preventing the upper mold and the lower mold from being separated by the inner work pressure.

17 Claims, 15 Drawing Sheets

HYDROFORMING METHOD AND HYDROFORMING DEVICE

BACKGROUND OF THE INVENTION

The present invention relates to a hydroforming device which processes a raw material by hydraulic pressure. Preferably, the present invention relates to a hydroforming device which processes a steel pipe into a automobile component. Additionally, the present invention relates to a hydroforming method which uses the hydroforming device of the present invention.

A conventional method for achieving high pressure using a hydraulic intensifier is disclosed in "Pipe Working Method", by Masanobu Nakamura, published by Nikkan Kogyo Shinbun Co. (Jan. 31, 1996). A further example of a conventional hydroforming device is disclosed in Japanese Laid-Open Patent Number 9-314240 (Japanese Patent Application Number 8-194175).

According to these conventional devices, when molding a steel pipe, the closing of the upper and the lower mold is conducted by a single closing cylinder disposed on the crown on the press machine. With this construction, in order to have the required closing force, the closing cylinder must have a large diameter and a large stroke length. As a result, the closing cylinder becomes a cylinder with a large volume. This type of construction is disadvantageous from the standpoint of high speed and responsiveness. In other words, the time needed for the closing motion is relatively long, thereby increasing production time.

Other conventional hydroforming devices process steel pipes by sending a high pressure fluid inside the pipe. In these hydroforming devices, by stroking a closing cylinder, an upper mold is raised and lowered, to supply the material inside the mold as well as to perform maintenance of the mold. As a result, it is necessary to manufacturer a press machine that is used exclusively for hydroforming.

For example, in Japanese Laid-Open Patent Publication Number 5-329693, a hydroforming press machine is disclosed that has a bed attached to a floor surface. Four columns pass through the bed in a freely vertically sliding manner. A crown is provided at the upper end of the columns. A lower frame is provided at the lower end of the columns. Four hydraulic cylinders drive the lower frame in a vertical direction.

OBJECTS AND SUMMARY OF THE INVENTION

It is an object of the present invention to provide a generic hydroforming device which is capable of hydroforming a raw material with a conventional press machine.

It is another object of the present invention to provide a hydroforming device which has high speed and high responsiveness, resulting in high productivity.

It is a further object of the present invention to provide a hydroforming method in which a raw material is molded at high speed and high responsiveness, resulting in a highly productive method of hyrdroforming.

Briefly stated, the present invention provides a plurality of closing cylinder devices disposed between a bolster of a press machine and a bed containing a lower mold of a hydroforming device. An upper mold is attached to a slide of the press machine. The upper mold and lower mold come together to form a cavity having the shape of the exterior of the desired molded product. A closing block, being movable between a first position which is between the slide and a crown of the press machine, and a second position, which avoids the slide, permitting free movement of the slide from the crown to the lower mold. When a material to be hydroformed is place in the lower mold, the upper mold is lowered. The closing block is fit into its first position, thereby restricting movement of the slide in the vertical direction. A inner work pressure is provided by a fluid inside the material to be molded. The closing cylinder devices provide a pressure, based upon the inner work pressure, to maintain the cavity at the desired shape, preventing the upper mold and the lower mold from being separated by the inner work pressure.

According to an embodiment of the present invention, the present invention provides a hydroforming method using a press machine, comprising: providing a closing block movable between a first position and a second position; the first position being between a crown of the press machine and a slide of the press machine, preventing movement of the slide above a predetermined maximum; the second position avoiding the slide, thereby allowing the slide to freely move to a lower surface of the crown of the press machine; providing a lower mold attached to a bolster of the press machine; providing an upper mold attached to the slide; the upper mold and the lower mold coming together to form a cavity having a shape of a molded product; providing a plurality of closing cylinder devices between a bed and the bolster; providing a material to be molded into the lower mold; lowering the slide so that the upper mold and the lower mold form the cavity; moving the closing block into the first position, thereby preventing raising of the slide; activating the closing cylinder devices to provide a closing force, maintaining the cavity during operation of the hydroforming method; and providing a work inner pressure from a liquid supplied to an interior of the material to be molded, whereby the work inner pressure shapes the material to the shape of the cavity while the closing cylinder devices maintain the cavity.

According to another embodiment of the present invention, the present invention provides a hydroforming device using a press machine, comprising: a closing block movable between a first position and a second position; the first position being between a crown of the press machine and a slide of the press machine, preventing movement of the slide above a predetermined maximum; the second position avoiding the slide, thereby allowing the slide to freely move to a lower surface of the crown of the press machine; a lower mold attached to a bolster of the press machine; an upper mold attached to the slide; the upper mold and the lower mold coming together to form a cavity having a shape of a molded product; a plurality of closing cylinder devices between a bed of the press machine and the bolster; means for providing a work inner pressure in a material to be molded by the hydroforming device; a closing force, generated by the plurality of closing cylinder devices, being controlled to rise with a rise in the work inner pressure, thereby maintaining the cavity at a desired shape during hydroforming operations.

According to a feature of the present invention, a hydroforming method includes providing a closing block, which is freely movable in a horizontal direction, on the crown of a press machine. The closing block moves between a position between the crown and a slide and a position which avoids the slide. A plurality of closing cylinder devices, raising and lowering the bolster, are disposed between the bed and the bolster of the press machine. A cavity is formed from the upper mold, which is anchored to the slide, and the lower mold, which is anchored to the bolster. An axial piston freely advances towards and retreats from an end surface of a work which is stored within the cavity. A closing force, controlled to rise with a rise in a work inner pressure, is generated by the closing cylinders. The work inner pressure being caused from a liquid supplied to the interior of the work by the shaft pushing piston. With such a method, the time needed for closing is shortened and a rational molding is anticipated.

According to a further feature of the present invention, the plurality of closing cylinders are suitably selected and operated, thereby optimizing the closing time and responsiveness.

According to a further embodiment of the present invention, a generic press machine, equipped with a clutch brake and a crank shaft, has a hydroforming device between its slide and its bolster. The hydroforming device includes a mold having a separated top and bottom, opposing shaft pushing cylinders, and a closing cylinder.

According to a feature of the present invention, a hydroforming device, for processing a tube material by hydraulic pressure, includes a base plate anchored to a bolster of a press machine. A closing cylinder is anchored to an upper surface of the base plate. A guide part is erected on the upper surface of the base plate. A middle plate, having a sliding part which joins with the guide part, allows for up and down movement. A lower mold is anchored to an upper surface of he middle plate. A die plate is anchored to a slide of the press machine. An upper mold is anchored to a lower surface of the die plate. An axial cylinder is equipped with a key which joins with a key groove provided on a lower surface of the die plate.

According to the previous embodiment and feature of the present invention, a hydroforming device is mounted on a generic press machine equipped with a clutch brake and a crank shaft. The upper mold is anchored to the slide via the die plate. The closing cylinder is anchored to the upper surface of the bolster via the base plate. When raising the upper mold in order to supply material to the mold or to conduct maintenance, the slide of the machine press is raised. When conducting hydroforming, the slide is held at the bottom dead center, and the upper mold and the lower mold are closed by the closing cylinder. In other words, by the hydroforming device of the present invention, a generic press machine, equipped with a clutch brake and a crank shaft, is used as the press machine for conducting hydroforming. Therefore, because existing press machines can be used, there is no need to manufacture an exclusive device for conducting hydroforming. Advanced hydroforming can be introduced into a manufacturing facility at a relatively low cost.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
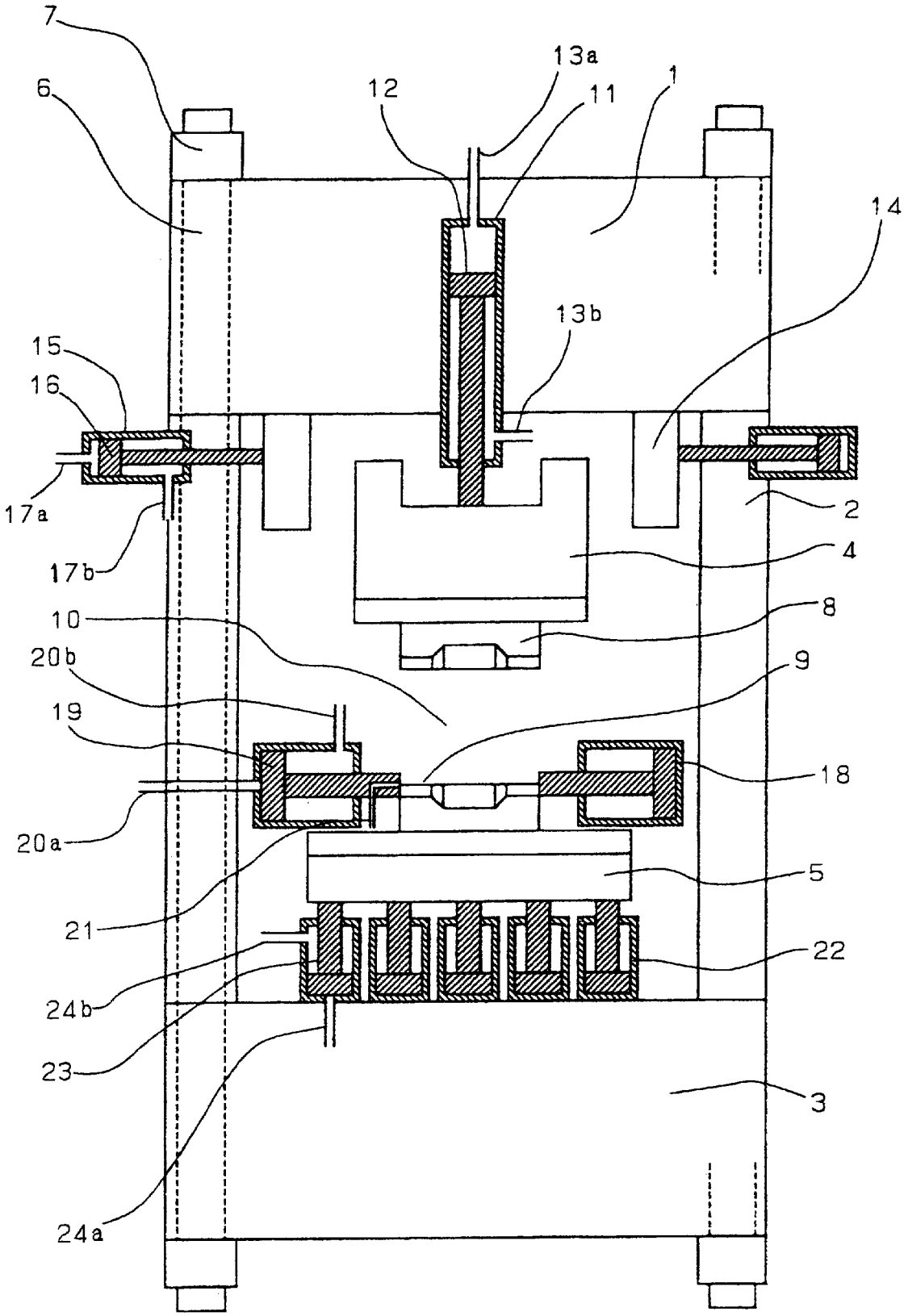
FIG. 1 is a longitudinal cross-section of a press machine having a hydroforming device according to an embodiment of the present invention.

Referring to FIG. 1, a crown 1, a column 2, and a bed 3 are fastened together by a tie rod 6 and a nut 7. These members construct a frame for a press machine. A slide cylinder 11 is provided on crown 1. A slide piston 12 is built into slide cylinder 11. Slide circuits 13*a* and 13*b* connect to slide cylinder 11.

A slide 4 is linked to the lower end of slide piston 12. Slide 4, guided by a guiding device (not shown) provided on column 2, freely rises and falls. Slide piston 12 rises and falls by the action of hydraulic pressure supplied from slide cylinder circuits 13*a* and 13*b*. Slide 4 rises and falls by the action of slide piston 12.

A closing block 14 is provided to allow for back and forth movement in the horizontal direction of FIG. 1. Closing block 14 is constructed to freely advance and retreat between a first position in which it is inserted between the lower surface of crown 1 and the upper surface of slide 4, to a second position, in which it avoids the upper surface of slide 4. A cylinder device 15, having a piston 16, connects to circuits 17*a* and 17*b*. Closing block 14 advances and retreats by the action of cylinder device 15.

An axial cylinder 18 is provided on column 2. An axial piston 19 is built into shaft pushing cylinder 18. Shaft pushing piston circuits 20*a* and 20*b* connect to shaft pushing cylinder 18. An axial piston circuit 21 connects to shaft pushing piston 19. Due to hydraulic pressure supplied from shaft pushing cylinder circuits 20*a* and 20*b*, shaft pushing piston 19 moves back and forth. In other words, shaft pushing piston 19 advances and retreats freely with respect to the upper and lower molds, which are later described.

A bolster 5, freely rising and falling, is provided on the top part of bed 3. In other words, bolster 5 is guided by a guiding device (not shown) provided on column 2. A closing cylinder 22 is present between bed 3 and bolster 5. In the present embodiment of the present invention, closing cylinder 22 is provided on top of bed 3. A closing piston 23 is built into closing cylinder 22. Closing circuits 24*a* and 24*b* connect to closing cylinder 22. Closing cylinder 22, closing piston 23, and closing cylinder circuits 24*a* and 24*b* construct the closing cylinder device.

The upper end surface of closing piston 23 contacts the lower surface of bolster 5. Closing piston 23 rises and falls by the liquid pressure supplied from cylinder circuits 24*a* and 24*b*. Bolster 5 rises and falls in conjunction with the rising and falling of closing piston 23. There are a plurality of closing cylinder devices placed at least at all corners underneath bolster 5. The closing cylinder devices can be selected and used according to the work, which is described later.

An upper mold 8 is anchored to the lower surface of slide 4. Opposite upper mold 8, a lower mold 9 is anchored to the upper surface of bolster 5. Upper mold 8 descends together with slide 4. When upper mold 8 meets with lower mold 9, they form the desired cavity 10. Cavity 10 indicates the space having a shape which becomes the outer shape for the molded product.

Figure 2:
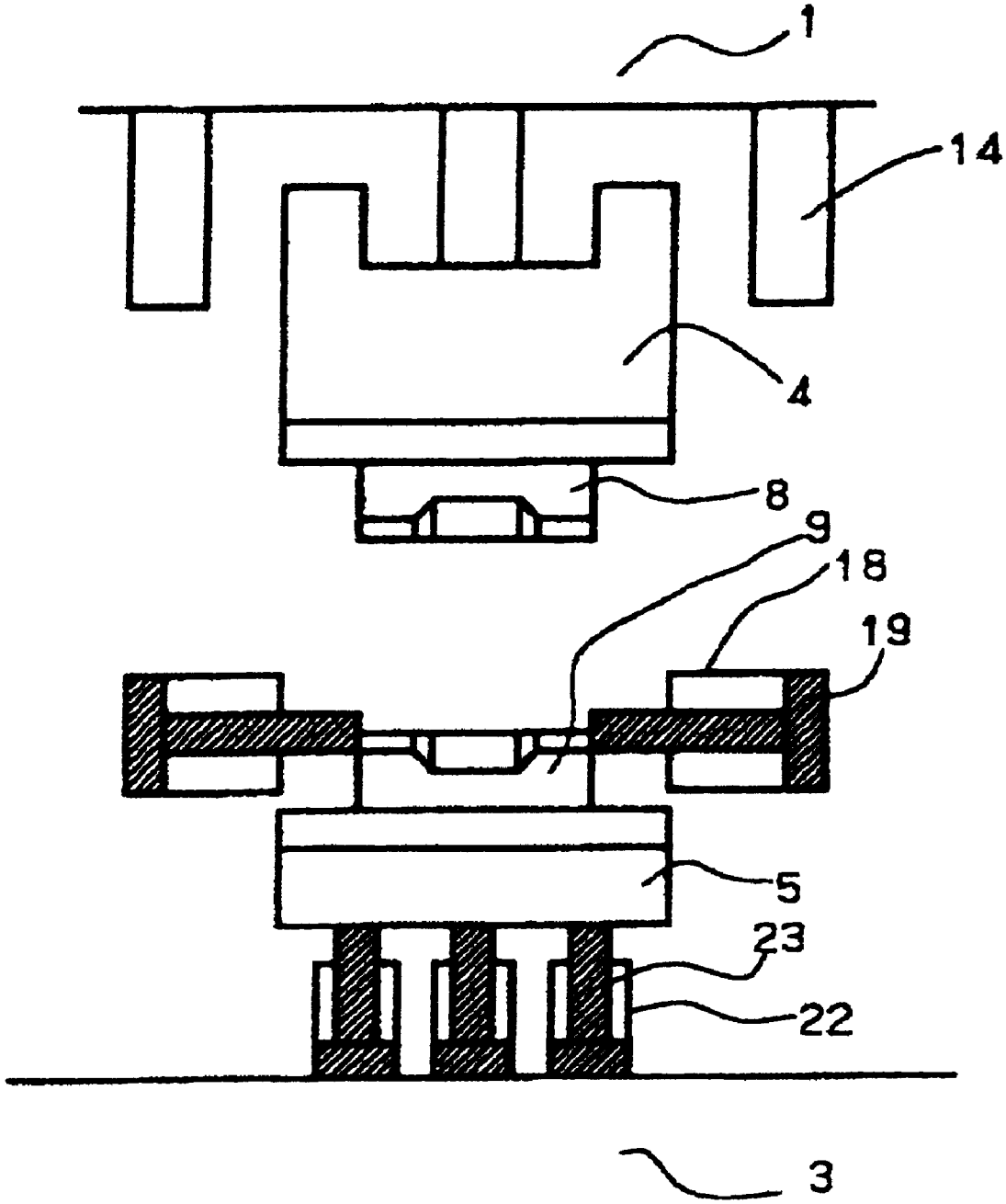
FIG. 2 is a descriptive drawing of the hydroforming method according to the present invention.

Referring to FIG. 2, when slide 4 is raised, bolster 5 is lowered, shaft pushing piston is retreated, and closing block 14 is retreated. At this point, a steel pipe (hereinafter referred to as the work) is supplied to lower mold 19.

Figure 3:
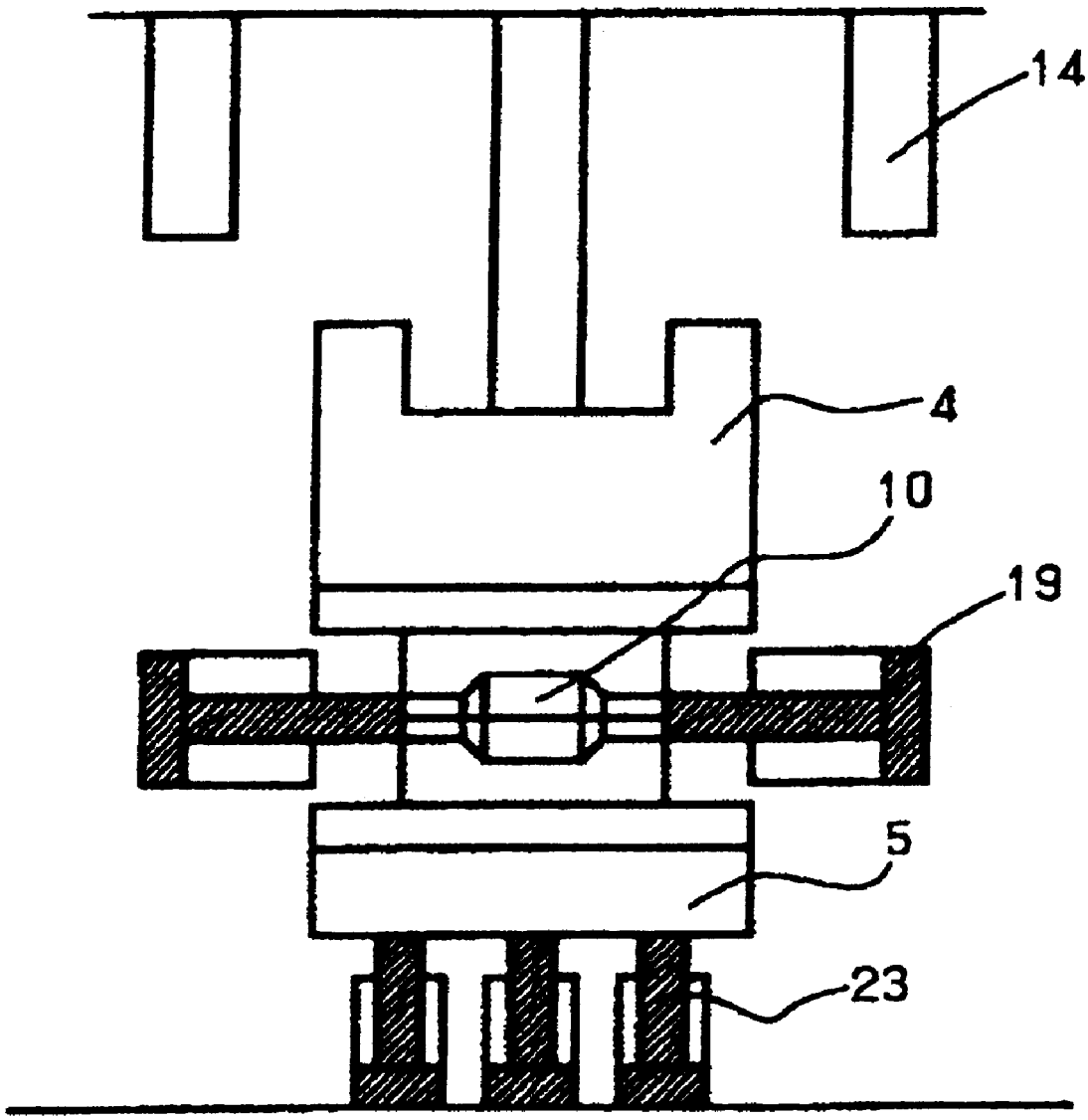
FIG. 3.is a descriptive drawing of the hydroforming method according to the present invention.

Referring to FIG. 3, slide 4 is lowered. Together with slide 4 being lowered, upper mold 8 descends. Lower mold 9 and upper mold 8 meet, and the work is housed in cavity 10.

Figure 4:
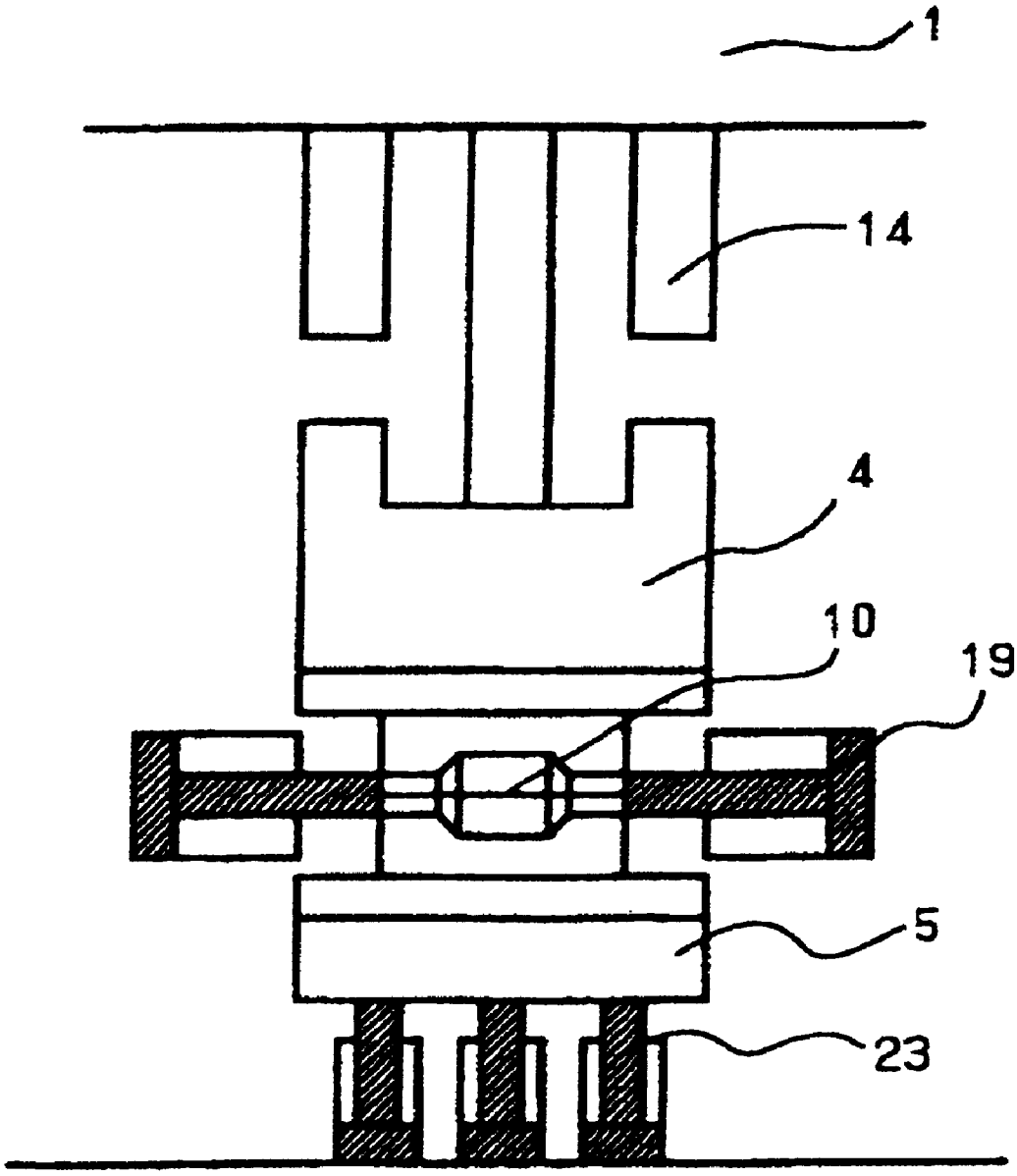
FIG. 4 is a descriptive drawing of the hydroforming method according to the present invention.

Referring to FIG. 4, closing block 14 advances and enters between the upper surface of slide 4 and the lower surface of crown 1.

Figure 5:
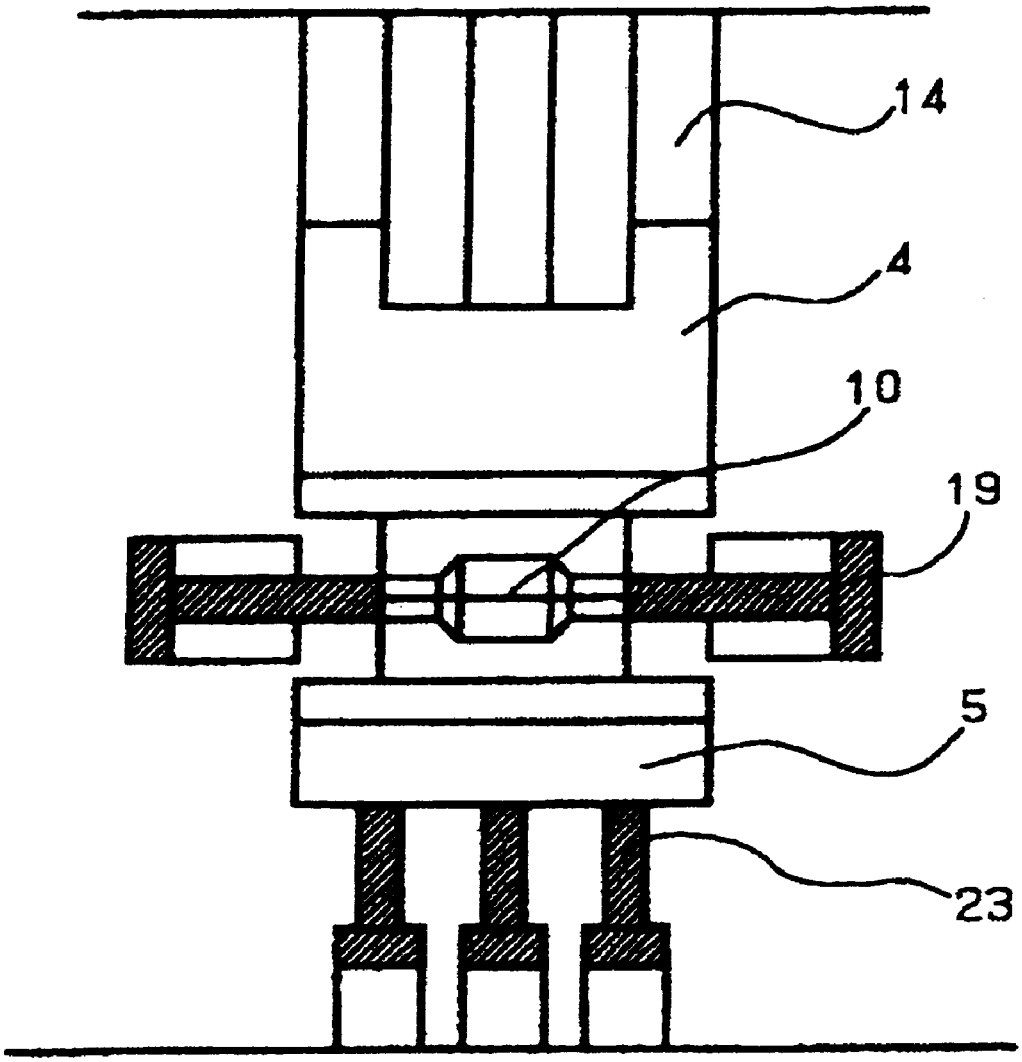
FIG. 5 is a descriptive drawing of the hydroforming method according to the present invention.

Referring to FIG. 5, bolster 5 rises due to the action of closing piston 23. The upper surface of slide 4 and the lower surface of closing 14 contact. With the closing force by closing piston 23, upper mold 8 and lower mold 9 are initially pressurized and closed.

Figure 6:
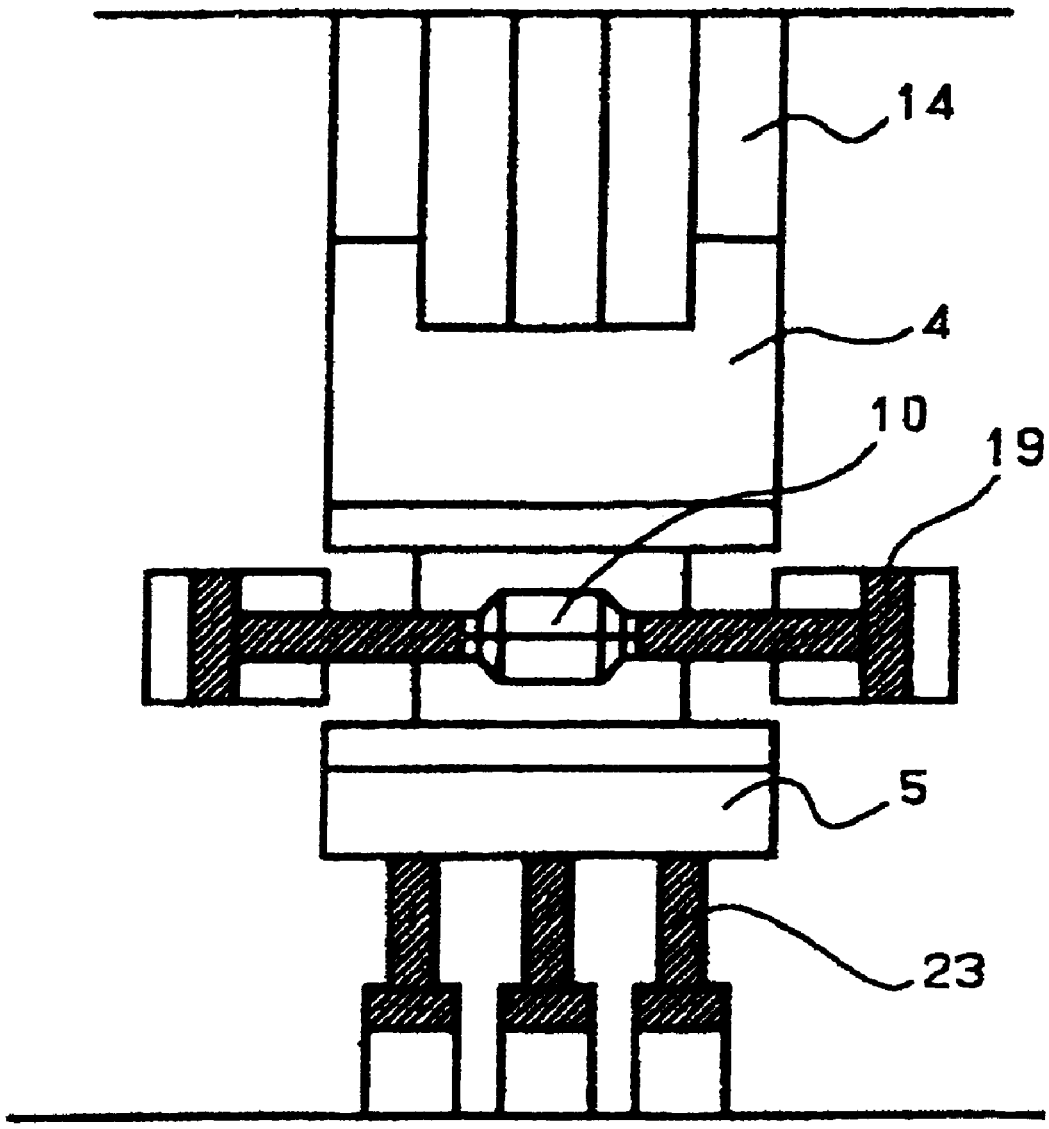
FIG. 6 is a descriptive drawing of the hydroforming method according to the present invention.

Referring to FIG. 6, shaft pushing piston 19 is advanced and positioned. When this occurs, the end part of shaft pushing piston 19 is inserted into the end inner diameter of the work. The end inner diameter part of the work becomes deformed a small amount. By this insertion motion, the outer part of shaft pushing piston 19 and the end inner diameter part of the work are in tight contact, acting to seal the hydraulic pressure within the work.

Figure 7:
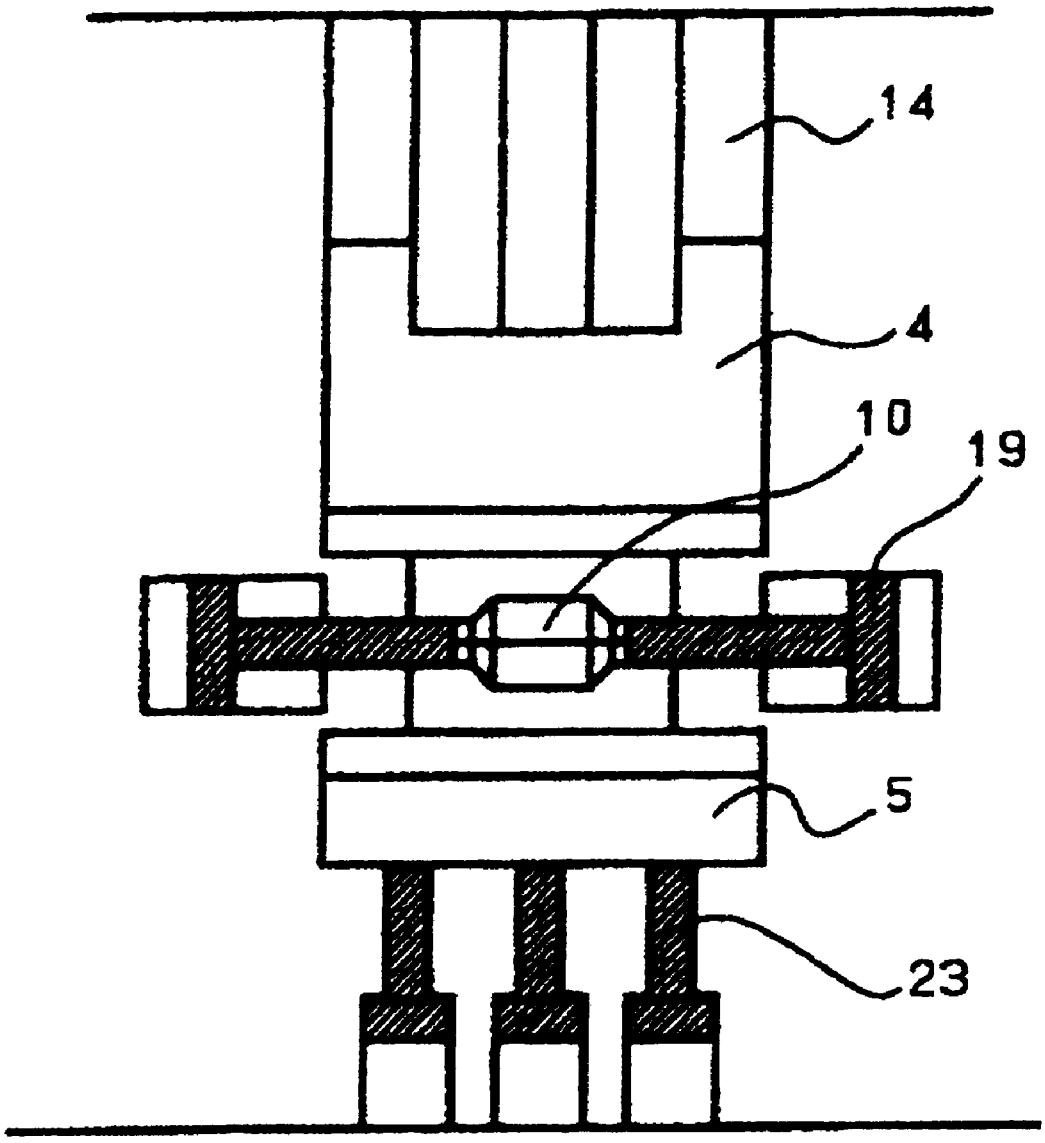
FIG. 7 is a descriptive drawing of the hydroforming method according to the present invention.

Referring to FIG. 7, when the molding (described below) is completed, the closing force from closing piston 19 is reduced.

Figure 8:
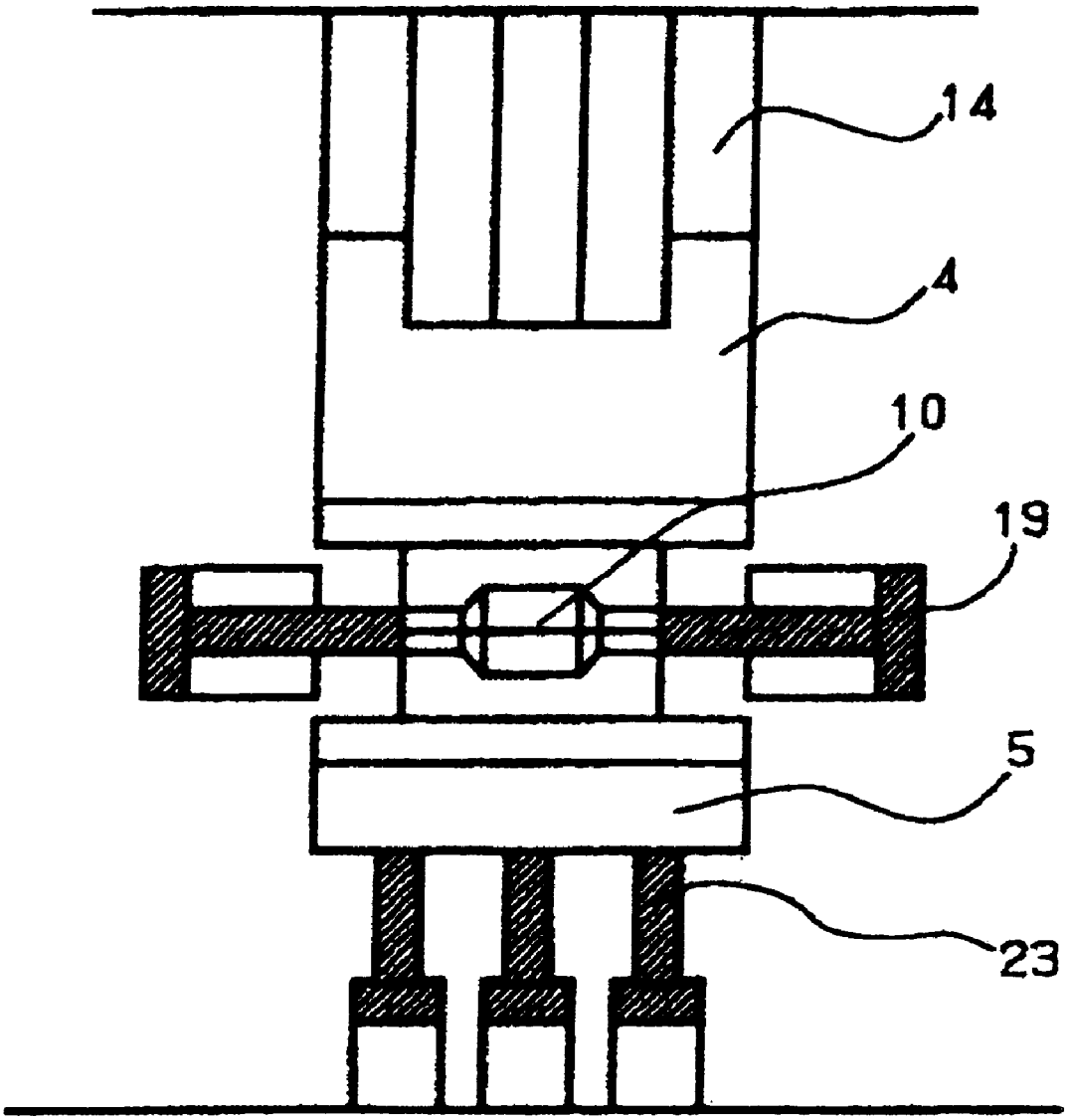
FIG. 8 is a descriptive drawing of the hydroforming method according to the present invention.

Referring to FIG. 8, shaft pushing piston 19 is retreated. At this point, the end part of the work is separated from the end part of shaft pushing piston 19.

Figure 9:
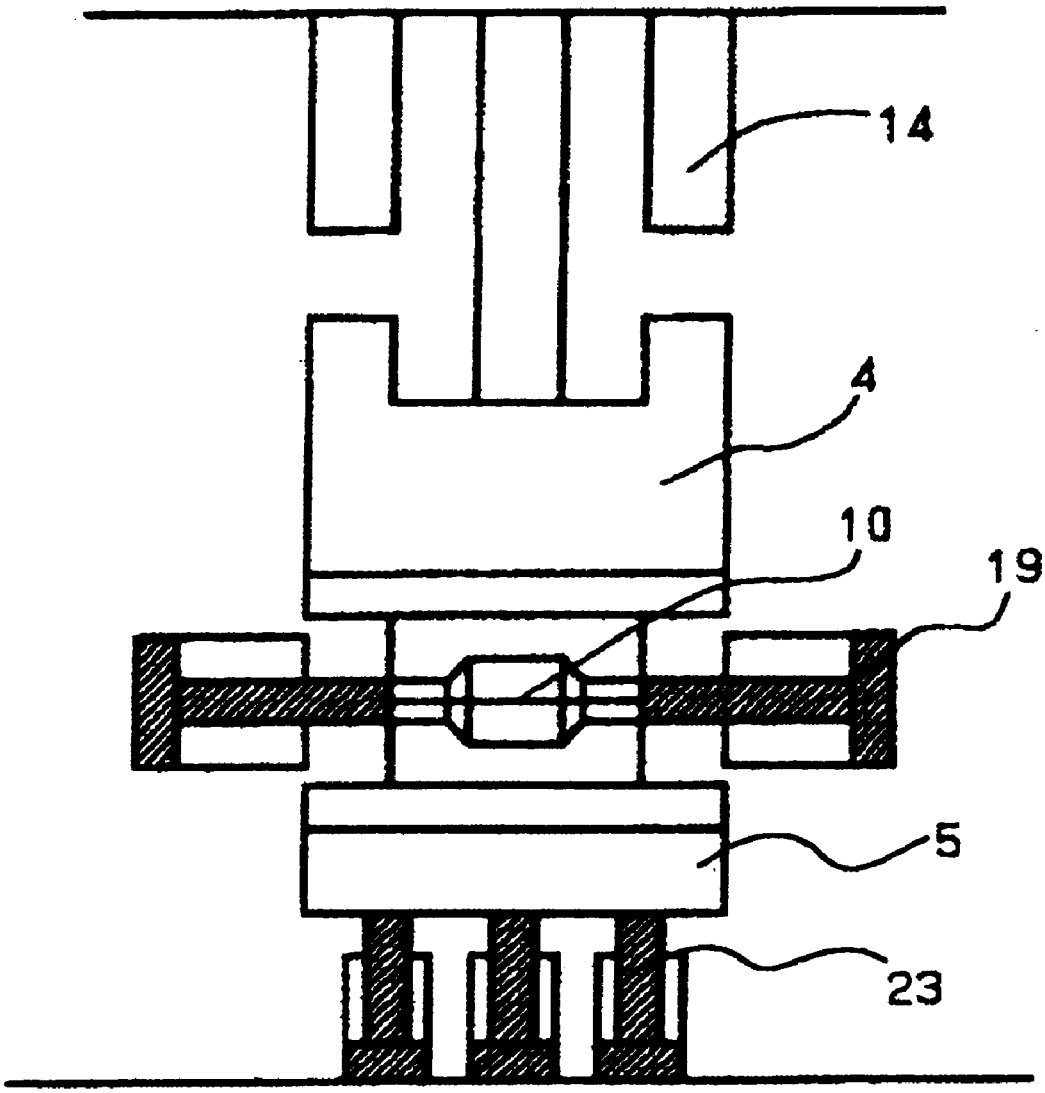
FIG. 9 is a descriptive drawing of the hydroforming method according to the present invention.

Referring to FIG. 9, bolster 5 is lowered, causing the closing force to become zero. A space is created between the lower surface of closing block 14 and the upper surface of slide 4.

Figure 10:
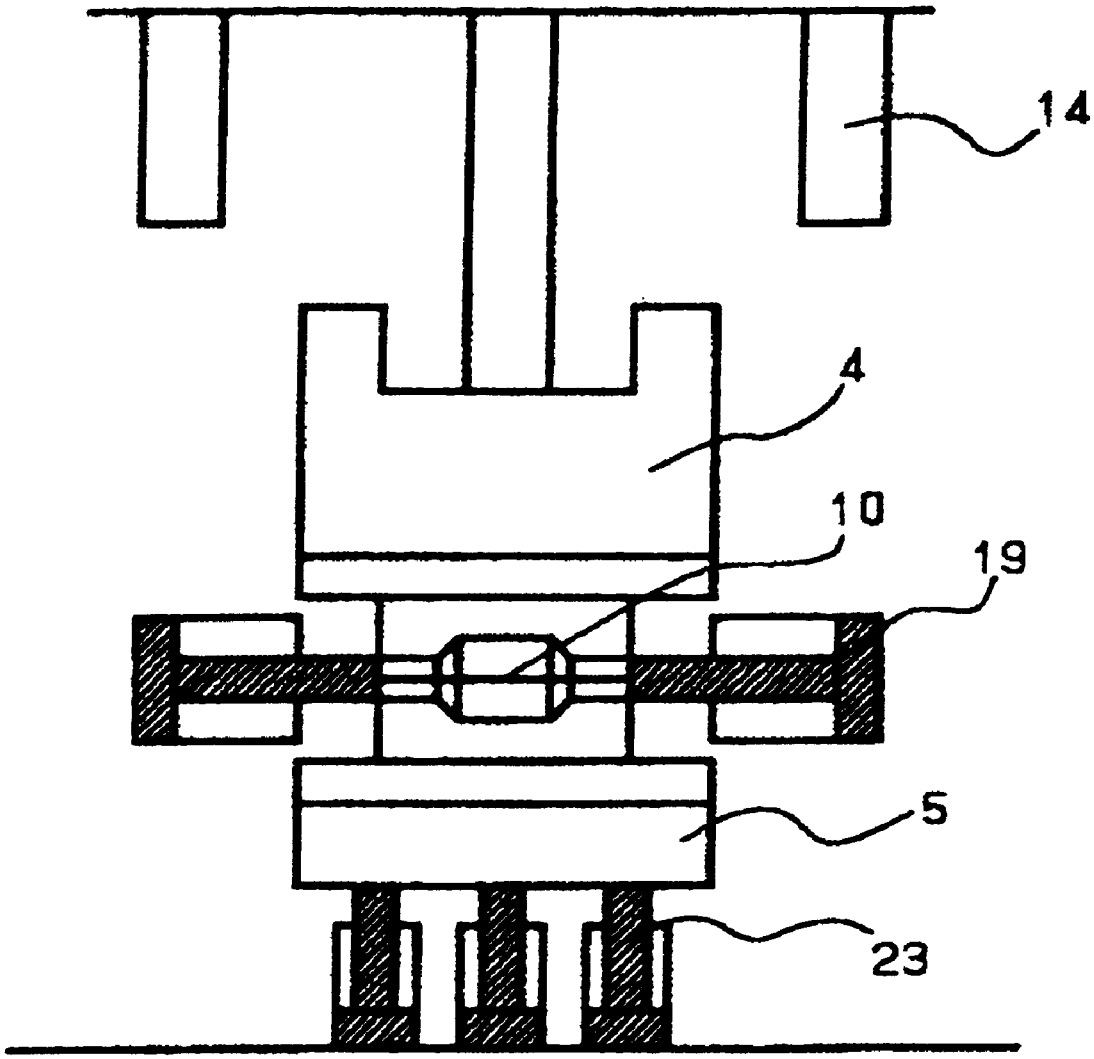
FIG. 10 is a descriptive drawing of the hydroforming method according to the present invention.

Referring to FIG. 10, closing block 14 is retracted.

Figure 11:
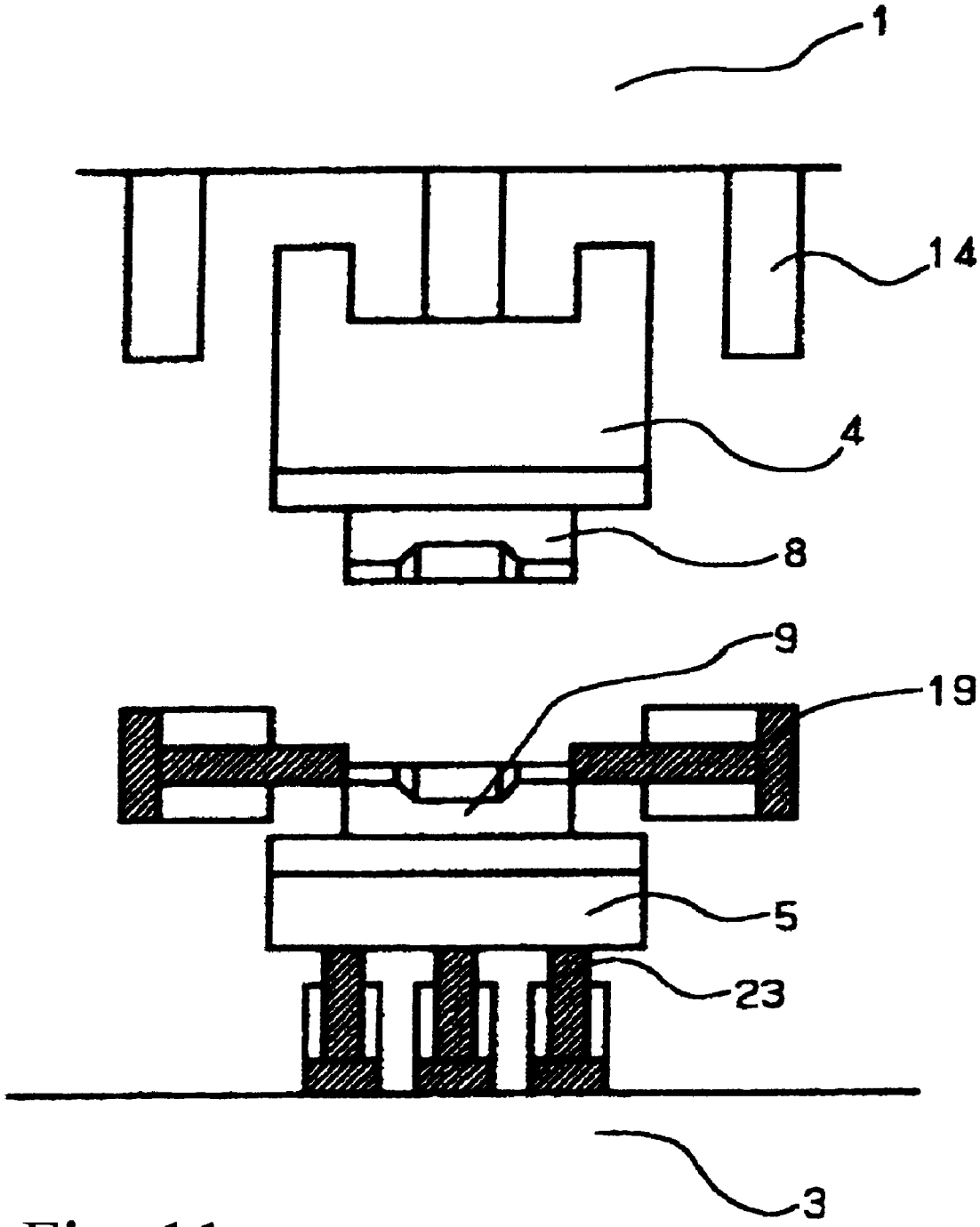
FIG. 11 is a descriptive drawing of the hydroforming method according to the present invention.

Referring to FIG. 11, slide 4 is raised. The molded product, which has been left in the lower mold upon raising slide 4, is removed. With this final step, the molding operation of the work is complete.

Referring back to FIG. 6, molding is conducted when the press is in the state as shown in FIG. 6. While closing by the action of closing piston 23, liquid is sent into the work interior from holes opened on shaft pushing piston 19. Synchronously with these motions, shaft pushing piston 19 is advanced.

Figure 12:
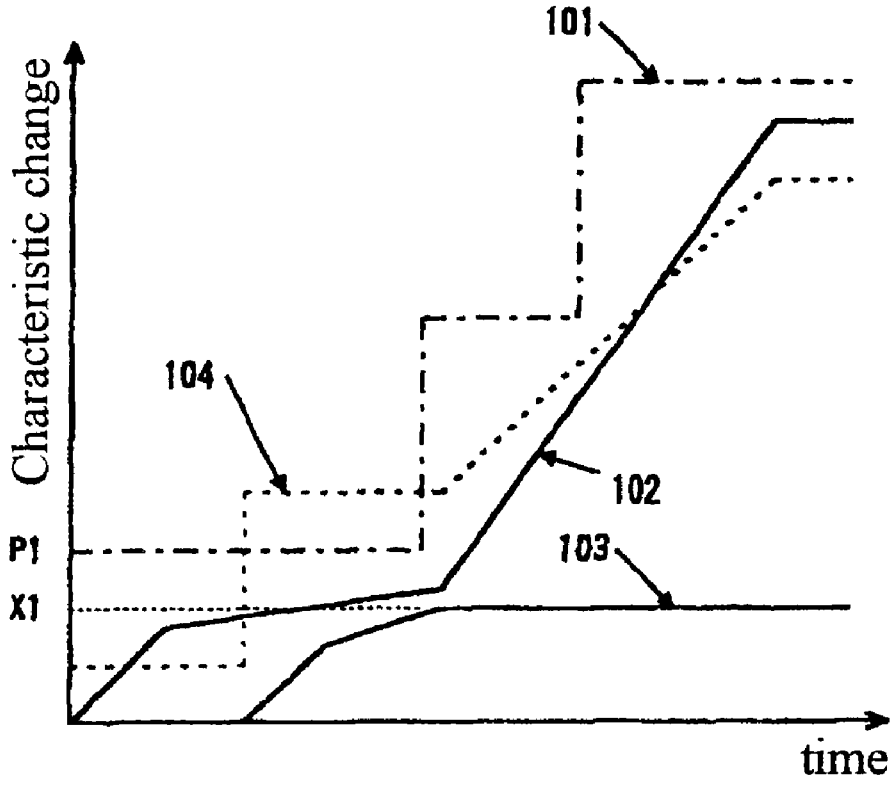
FIG. 12 is a graph showing characteristic changes as a function of time.

Referring to FIG. 12, the changes in closing force, inner pressure of the work, displacement amount of shaft pushing piston 19, and the hydraulic pressure of shaft pushing cylinder 18 are shown.

Closing force 101, work inner pressure 102, and displacement amount 103 of shaft pushing piston 19 are controlled based on time. Hydraulic pressure 104 of shaft pushing cylinder 18 is the result of controlling displacement amount 103 of shaft pushing piston 19. Hydraulic pressure 104 of shaft pushing cylinder 18 is a monitor, so to speak. Displacement amount 103 of shaft pushing piston 19 is detected at a linear scale (not shown).

Closing force 101 rises with inner pressure 102 of the work. If the closing force is high from the start, upper mold 8 and lower mold 9 are deformed, and the frictional force between the mold and the work increases. There is seizing of the mold and the work, and the molding of the work is obstructed. In other words, it is necessary to change the closing force according to the rise of hydraulic pressure acting on the inner diameter part of the work. In other words, it is necessary to change the closing force according to the rise in inner pressure 102 of the work.

Closing force 101 at the initial step is P1. At this closing force P1, work inner pressure 102 is applied within the range where upper mold 8 and lower mold 9 do not open, and the work is molded by the work inner pressure 102. In order to prevent the work from being thinned, or in order to prevent breaking of the work, shaft pushing piston 19 is advanced. Displacement amount 103 in this initial step is X1. Most of the molding work is completed in this initial step.

In the next step, closing force 101 is raised, and work inner pressure 102 is also raised. In this step, as described previously, because most of the molding work is completed, there is hardly any need to advance pushing piston 19. In this step, molding of the corner parts, and the like, of the work is completed.

In the next step, closing force 101 is raised, and work inner pressure 102 is also raised. The outer shape of te work is accurately made into the shape of the cavity. Pressure is applied so that there is no deformation due to the so-called spring back phenomenon, occurring when the work is released from the upper and lower molds.

Following the above technical idea, closing force 101, work inner pressure 102, and displacement amount 103 of shaft pushing piston 19 are controlled. When molding is completed, the product is obtained following the series of motions in FIGS. 7–11, as previously described.

According to this embodiment of the present invention, by the action of closing block 14, only a relatively short cylinder as with the closing cylinder is necessary. As a result, the hydroforming device of the present invention has the advantage of requiring a shortened time for closing, as well as good responsiveness. Furthermore, when operating by selecting from among a plurality of closing cylinder devices, the time needed for closing is further shortened, resulting is a further enhancement of the responsiveness of the hydroforming device.

Figure 13:
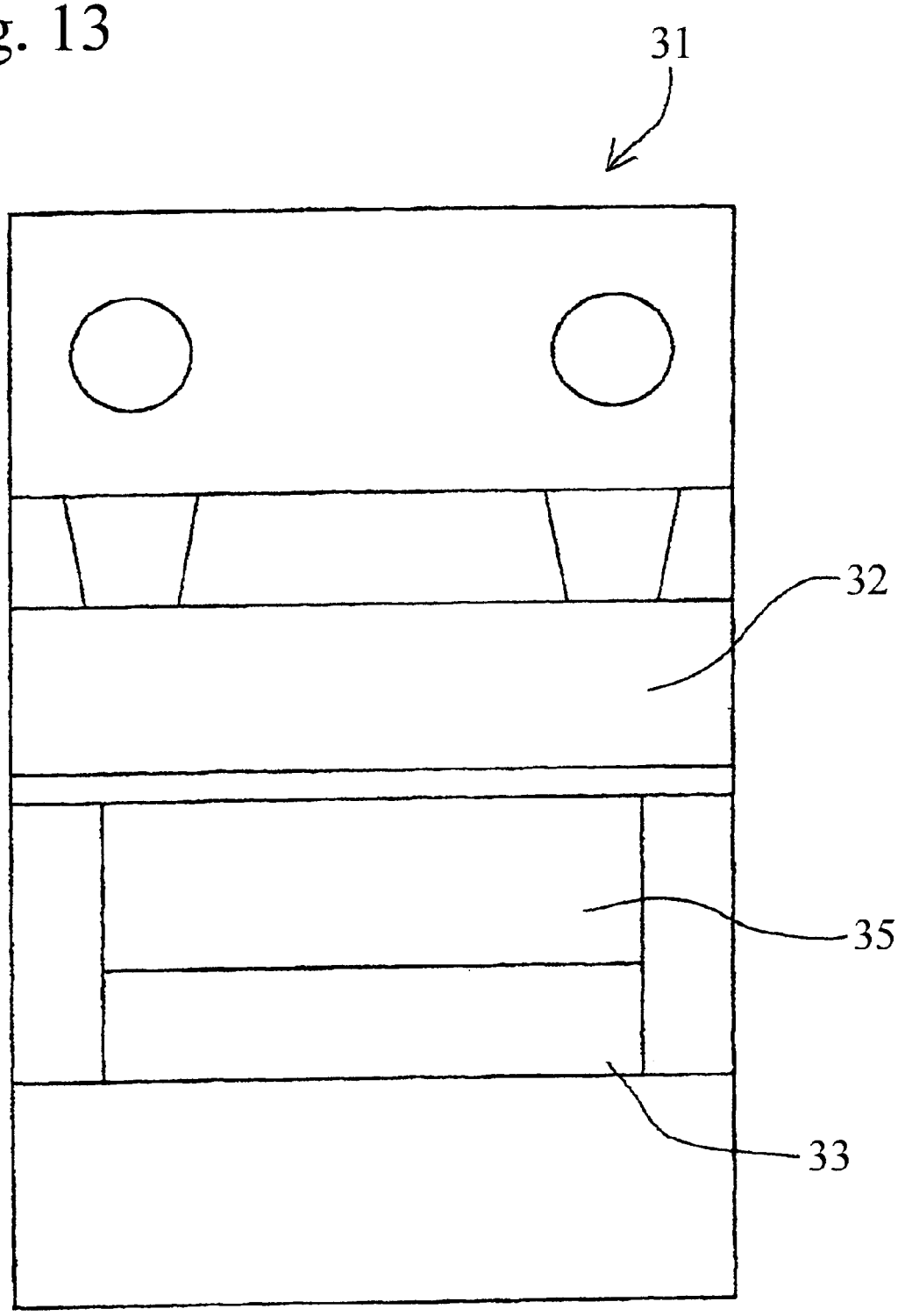
FIG. 13 is a schematic diagram of a generic press machine.

Referring to FIG. 13, a generic press machine 31 vertically raises and lowers a slide 32 by a driving mechanism (not shown). A hydroforming device 35 is provided between a slide 32 and a bolster 33 of press machine 31.

Figure 14:
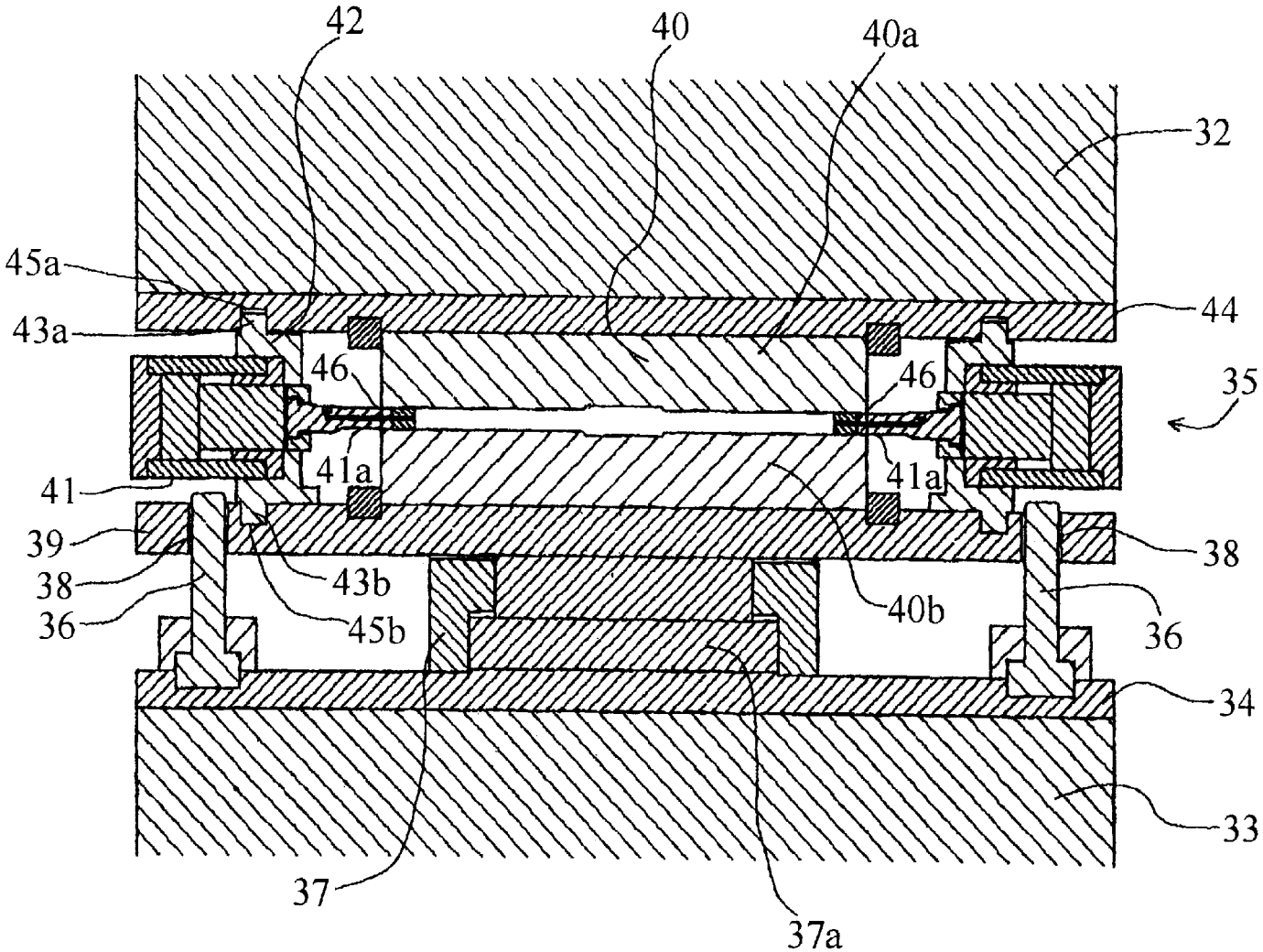
FIG. 14 is a detailed drawing of a hydroforming device.

Referring to FIG. 14, slide 32 is shown at the bottom dead center. A base plate 34 is anchored to bolster 33. A die plate 44 is anchored to slide 32. A closing cylinder 37 is anchored on top of base place 34. Furthermore, on the four corners on top of base plate 34, a guide part 36, which uses guide posts, is erected. Sliding parts 38 are provided on the four corners of a middle plate 39. Sliding parts 38 join with guide part 36 in a condition where sliding parts 38 are freely mobile in the vertical direction. Sliding parts 38 support middle plate 39. Furthermore, the upper surface of closing cylinder 37 contacts the lower surface of middle plate 39. Middle plate 39 rises and falls along with the rise and fall of piston 37*a* of closing cylinder 37.

Lower mold 40*b* is anchored to the upper surface center part of middle plate 39. In addition, upper mold 40*a* is anchored to the lower surface center part of die plate 44. Shaft pushing cylinders 41 are provided on right and left sides of mold 40. The lower part of a block 42, which is anchored to shaft pushing cylinder 41, is anchored to middle plate 39. Furthermore, a key 43*a*, which is provided on the upper part of block 42, joins with a key groove 45*a*, which is provided on die plate 44. A key 43*b*, which is provided on the lower part of block 42, joins with a key groove 45*b*, which is provided on middle plate 39. When slide 32 is at the bottom dead center, and piston 37*a* is at the lower limit position, there is a space between the bottom part of key groove 45*a* and the upper surface of key 43*a*.

When hydroforming is to be conducted, slide 32 is at the bottom dead center, and the material is supplied to the inside of mold 40. After supplying the material, slide 32 is at the bottom dead center, and piston 37*a* of closing cylinder 37 is raised. Thereupon, middle plate 39 is pushed up, and mold 10 is closed. At this time, there is a space between the bottom part of key groove 45*a* and the upper surface of key 43*a*.

When the mold is closed, rod parts 41*a* of shaft pushing cylinders 41 advance to the inside of the mold from holes 46, provided on the right and left side surfaces of mold 40, and rod parts 41 a are inserted into the steel pipe end part of the material. High pressure fluid flows into the steel pipe, and the steel pipe is processed into the desired shape. At this time, shaft pushing cylinders 41 receive the reaction force of rods 41*a* in the lengthwise direction. However, because keys 43*a* and 43*b* are joined with key grooves 45*a* and 45*b*, shaft pushing cylinders 41 do not shift from the reaction force. After completion of the precessing, rod parts 41*a* of shaft pushing cylinders 41 are retreated, and piston 37*a* of closing cylinder 37 is lowered, releasing the upper mold from the lower mold. Afterwards, with slide 32 in the bottom dead center, the product is removed from inside the mold, and the processing is completed.

Figure 15:
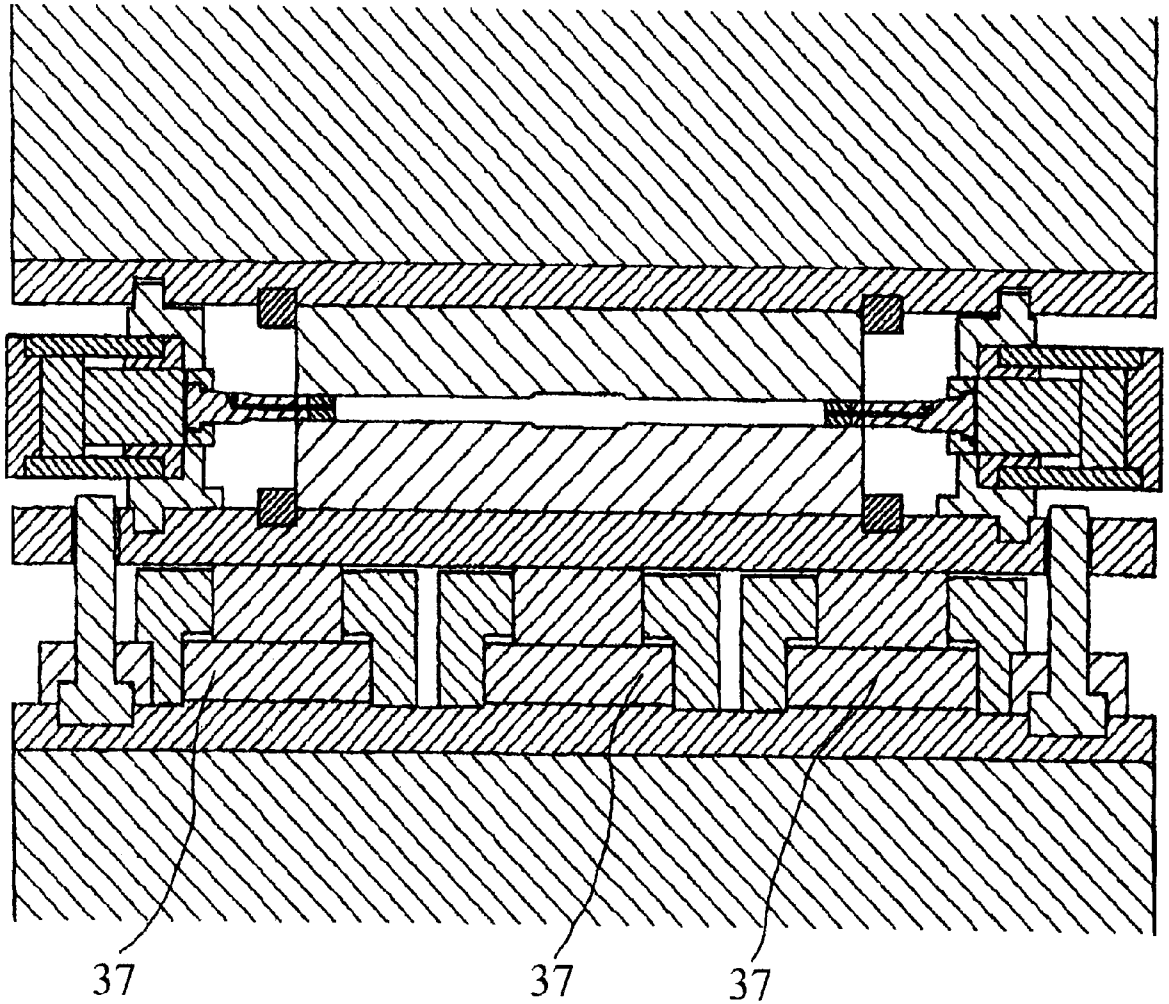
FIG. 15 is a detailed drawing of a hydroforming device according to an alternate embodiment of the present invention.

Referring to FIG. 15, there is preferably a plurality of closing cylinders in the hydroforming device.

For the frame construction of press machine 31, any known frame construction, such as a gate type or a C-frame, may be used, so long as it is a press machine having a suitable frame strength to withstand the closing force. Furthermore, with respect to the drive mechanism of slide 32, any known drive mechanism may be used, such as a crank mechanism or a knuckle mechanism.

According to this embodiment of the present invention, hydroforming is conducted with a generic press machine which is equipped with a clutch brake and a crank shaft. As a result, it is not longer necessary to manufacture a machine exclusively for hydroforming, thereby allowing hydroforming to be introduced into a manufacturing facility at a relatively low cost.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A hydroforming method using a press machine, comprising:

providing a closing block movable between a first position and a second position;

said first position being between a crown of said press machine and a slide of said press machine, providing a restriction in movement of said slide;

said second position avoiding said slide, thereby removing said restriction, allowing said slide to move freely;

providing a lower mold attached to a bolster of said press machine;

providing an upper mold attached to said slide;

said upper mold and said lower mold coming together to form a cavity having a shape of a molded product;

providing a plurality of closing cylinder devices between a bed and said bolster;

providing a material to be molded into said lower mold;

lowering said slide so that said upper mold and said lower mold form said cavity;

moving said closing block into said first position, thereby preventing raising of said slide;

activating said closing cylinder devices to provide a closing force, maintaining said cavity during operation of said hydroforming method; and supplying a liquid to an interior side of said material to be molded, said interior side being opposite an exterior side which faces walls of said cavity, whereby said work inner pressure shapes said material to said shape of said cavity while said closing cylinder devices maintain said cavity.

2. The hydroforming method according to claim 1, further comprising:

providing a shaft pushing piston advancing towards and retreating from an end surface of said material to be molded;

said shaft pushing piston pushing said end surface during said molding, thereby preventing said material from thinning and breaking.

3. The hydroforming method according to claim 2, wherein said shaft pushing piston includes a first shaft pushing piston and a second shaft pushing piston at opposite sides of said material to be molded.

4. The hydroforming method according to claim 1, wherein said closing block includes a first closing block and a second closing block at substantially opposite sides of said slide.

5. The hydroforming method according to claim 1, wherein said closing block is of a size such that said activating step requires said closing cylinder devices to displace said bed a minimal distance in order to form and maintain said cavity.

6. The hydroforming method according to claim 1, further comprising the steps of:

adapting a generic press machine for hydroforming; and performing said hydroforming of claim 1 using a non-dedicated hydroforming press device.

7. A hydroforming device using a press machine, comprising:

a closing block movable between a first position and a second position;

said first position being between a crown of said press machine and a slide of said press machine providing a restriction in movement of said slide;

said second position avoiding said slide, thereby removing said restriction, allowing said slide to move freely;

a lower mold attached to a bolster of said press machine;

an upper mold attached to said slide;

said upper mold and said lower mold coming together to form a cavity having a shape of a molded product;

a plurality of closing cylinder devices on said bolster of said press machine;

a bed of said press machine on said plurality of closing cylinder devices;

means for providing a work inner pressure in a material to be molded by said hydroforming device; and wherein said plurality of closing cylinder devices provides a closing force controlled to rise with a rise in said work inner pressure, thereby maintaining said cavity at a desired shape during hydroforming operations.

8. The hydroforming device according to claim 7, further comprising:

an axial piston advancing towards and retreating from said cavity;

said shaft pushing piston pushing an end surface of said material to be molded during said molding, thereby preventing said material from thinning and breaking.

9. The hydroforming device according to claim 8, wherein said shaft pushing piston includes a first shaft pushing piston and a second shaft pushing piston at opposite sides of said material to be molded.

10. The hydroforming device according to claim 7, wherein said closing block includes a first closing block and a second closing block at substantially opposite sides of said slide.

11. The hydroforming device according to claim 7, wherein said closing block is of a size such that said closing cylinder devices displace said bed a minimal distance in order to form and maintain said cavity.

12. A hydroforming device comprising:

a base plate anchored to a bolster of a press machine;

said base plate having an upper and a lower surface, said upper surface facing a location where a material is molded by said hyrdoforming device;

at least one closing cylinder anchored to said upper surface of said base plate;

at least one guide part on said upper surface of said base plate;

a middle plate having a sliding part joining with said guide part in a manner allowing for up and down movement;

said middle plate having an upper and a lower surface, said upper surface facing a location where a material is molded by said hyrdoforming device;

a lower mold anchored to said upper surface of said middle plate;

a slide slidably attached to a crown of said press machine;

a die plate anchored to a first surface of said slide of said press machine;

an upper mold anchored to a second, opposite surface of said die plate;

a key groove in said second, opposite surface of said die plate;

an axial cylinder equipped with a key which joins with said key groove.

13. A hydroforming device according to claim 12, wherein said axial cylinder includes a first axial cylinder and a second axial cylinder at opposite sides of said material to be molded.

14. A hydroforming device according to claim 12, wherein said press machine is a generic press machine adapted for a hydroforming method, whereby said hydroforming method is performed by a non-dedicated hydroforming press device.

15. A hydroforming method for processing a material by hydraulic pressure by using a hydroforming device comprising the steps of:

providing a base plate comprising an upper and lower surface;

anchoring a base plate to a bolster of a press machine;

locating said upper surface of said base plate facing a material to be molded;

anchoring at least one closing cylinder to said upper surface of said base plate;

providing at least one guide part on said upper surface of said base plate;

providing a middle plate comprising an upper surface, a lower surface and a sliding part;

joining said sliding part with said guide part in a manner allowing for up and down movement;

locating said upper surface of said middle plate facing a material to be molded;

anchoring a lower mold to said upper surface of said middle plate;

slidably attaching a slide to a crown of said press machine anchoring a die plate to a first surface of said slide of said press machine;

anchoring an upper mold to a second, opposite surface of said die plate;

providing a key groove in said second, opposite surface of said plate; and equipping an axial cylinder with a key which joins with said key groove.

16. The hydroforming method according to claim 15, further comprising the step of providing a first axial cylinder and a second axial cylinder at opposite sides of said material to be molded.

17. The hydroforming method according to claim 15, further comprising the steps of:

adapting a generic press machine for hydroforming; and performing said hydroforming of claim 12 using a non-dedicated hydroforming press device.

* * * * *